US005853903A

United States Patent [19]

Hosoya et al.

[11] Patent Number: 5,853,903

[45] Date of Patent: Dec. 29, 1998

[54] STEEL SHEET FOR EXCELLENT PANEL APPEARANCE AND DENT RESISTANCE AFTER PANEL-FORMING

[75] Inventors: Yoshihiro Hosoya; Fusato Kitano, both of Fukuyama, Japan; Yasunobu Nagataki, Evanston, Ill.

[73] Assignee: NKK Corporation, Tokyo, Japan

[21] Appl. No.: 847,896

[22] Filed: Apr. 28, 1997

[30] Foreign Application Priority Data

May 7, 1996 [JP] Japan ..... 8-137651

[51] Int. Cl.[6] ..... B32B 15/01

[52] U.S. Cl. ..... 428/669; 148/320; 420/120; 420/121; 420/126; 420/127; 420/128

[58] Field of Search ..... 148/320; 420/120, 420/121, 126, 127, 128; 428/669

[56] References Cited

U.S. PATENT DOCUMENTS

| | | | |
|---|---|---|---|
| 4,496,400 | 1/1985 | Irie et al. | 420/127 |
| 4,750,952 | 6/1988 | Sata et al. | 148/320 |
| 5,133,815 | 7/1992 | Hashimoto et al. | 148/319 |
| 5,656,102 | 8/1997 | Taylor et al. | 148/320 |
| 5,690,755 | 11/1997 | Yoshinaga et al. | 148/533 |

FOREIGN PATENT DOCUMENTS

| | | |
|---|---|---|
| 0 572 666 A1 | 12/1993 | European Pat. Off. . |
| 57-70258 | 4/1982 | Japan . |
| 61-276931 | 12/1986 | Japan . |
| 3-277741 | 12/1991 | Japan . |
| 4-2729 | 1/1992 | Japan . |
| 4-173925 | 6/1992 | Japan . |
| 7-278654 | 10/1995 | Japan . |

OTHER PUBLICATIONS

Patent Abstracts of Japan, vol. 096, No. 002, 29, Feb, 1996 of JP 07 278654 (Nippon Steel Corp), 24, Oct. 1995.

Patent Abstracts of Japan, vol. 016, No. 479 (C–0992), 6, Oct. 1992 of JP 04 173925 (Nisshin Steel Co., LTD.) 22, Jun. 1992.

Database WPI, Section Ch, Week 9207, Derwent Publications Ltd., London, GB; Class M24, AN 92–054234 of JP 04 002 729 (Sumitomo Metal Ind. LTD.), 7, Jan. 1992.

*Primary Examiner*—John Sheehan

*Attorney, Agent, or Firm*—Frishauf, Holtz, Goodman, Langer & Chick, P.C.

[57] ABSTRACT

A cold-rolled steel sheet or a zinc or zinc alloy layer coated steel sheet containing 0.0010 to 0.01 wt % of C and having a steel composition containing one or two kinds of 0.005 to 0.08 wt % of Nb and 0.01 to 0.07 wt % of Ti in the ranges given by $\{(12/93)Nb+(12/48)Ti^*\} \geqq 0.0005$, $0 \leqq C-\{(12/93)Nb+(12/48)Ti^*\} \leqq 0.0015$, and $Ti^*=Ti-\{(48/32)S+(48/14)N\}$, in which a bake hardenability BH f the steel sheet at 170° C.×20 min after 2% tensile prestrain is 10 to 35 MPa and the BH (MPa) and a yield strength YP (MPa) of the steel sheet satisfy the ranges given by $BH \geqq \exp(-0.115 \cdot YP+23.0)$ and $0.67 \cdot BH+160 \leqq YP \leqq -0.8 \cdot BH+280$.

11 Claims, 8 Drawing Sheets

WORK-HARDENING EXPONENT (0.5~2%STRAIN):n

| | STRAIN RATE | | REMARK |
|---|---|---|---|
| | $3\times10^{-3}$/sec | $3\times10^{-1}$/sec | |
| ○ | n≧0.25 | n≧0.25 | PRESENT INVENTION |
| ◔ | 0.20≦n<0.25 | | |
| ◕ | n<0.20 | | |
| ◑ | 0.20≦n<0.25 | n<0.25 | COMPARISON |
| ○ | n<0.20 | | |

* ΔWca >0.2μm

| ΔWca (μm) | PLAIN-STRAIN | | |
|---|---|---|---|
| | NONE | PERMISSIVE | INFERIOR |
| 0 | ○ | ◔ | ◑ |
| ≦0.2 | ◕ | ◕ | ◕ |
| >0.2 | ◐ | ◕ | ● |

STEEL SHEET FOR EXCELLENT PANEL APPEARANCE AND DENT RESISTANCE AFTER PANEL-FORMING

BACKGROUND OF THE INVENTION

1. Field of the Invention

The present invention relates to a steel sheet used for outer panels of automobiles and the like, and more particularly, relates to a cold-rolled steel sheet. and a cold-rolled steel sheet coated with a zinc or zinc alloy layer having excellent formability and nonageing properties, and further, producing no surface defects at press-forming, and exhibiting excellent dent resistance after baking 2. Description of the Related Art As a matter of course, cold-rolled steel sheets used for outer panels of automobiles and the like are required to have excellent characteristics such as formability, shape fixability and surface uniformity(plane strain); and in addition, such characteristics are also required that automobile bodies with the steel sheets are not readily dented by a local external stress. Concerning the former characteristics, numerous techniques have been disclosed, according to which, parameters conventionally used for evaluating formability of steel sheet such as elongation, r value, and n value are improved. Meanwhile, concerning the latter characteristics, increasing the yield point of steel sheet has been investigated simultaneously with decreasing sheet thickness for lightening the automobile body weight to achieve reduction in cost of automotive fuel, since the dent load of steel sheet increases with Young's modulus, (sheet thickness)$^2$ and yield strength. However, an increase in the yield strength of steel sheet increases the spring back at press-forming, and thereby surface nonuniformity is readily produced around door handles in addition to deterioration of shape fixability. Conventionally, it has been known that surface nonuniformity is readily produced when the yield strength of steel sheet exceeds 240 MPa under normal press-forming conditions.

So-called BH steel sheets (steel sheets having bake hardenability), which have such characteristics that the yield strength is low at press-forming and is raised by a strain ageing phenomenon after baking (generally heating at 170° C. for approximately 20 min.), have been developed to solve the above problems and numerous improved techniques concerning this type of steel sheet have been disclosed. These BH steel sheets are characterized by a phenomenon, in which the yield strength increases due to strain ageing after baking by leaving a small amount of C in solid solution in the steel. However, when utilizing such a strain ageing phenomenon, ageing deterioration (reappearance of yield point elongation) more readily occurs in steel sheets during storage at room temperature as compared with nonageing steel sheets, thereby surface defects due to stretcher strain readily occur at press-forming.

Therefore, steel sheets having a two-phase structure have been developed as yield point elongation does not readily reappear in such steel sheets at ageing, in which two-phase structure, a low temperature transformation phase such as martensite dispersed in ferrite, is formed by a continuous annealing process. Although this type of steel sheet has BH as high as approximately 100 MPa, it is made of low carbon steel containing approximately 0.02 to 0.06 wt % of C; therefore this type of steel sheet cannot satisfy the formability required for today's outer panels of automobiles, and in addition, it cannot achieve the desired microstructure since it cannot be subjected to quenching or tempering when steel sheet is hot-dip galvanized. Furthermore, deterioration in stretch-flangeability and the like specific to the two-phase structure steel prevents this type of steel sheet from being used for outer panels.

Meanwhile, so-called ultra-low carbon BH steel sheets have been developed by employing ultra-low carbon steel, containing not more than 0.005 wt % of C, and adding carbide forming elements such as Nb and Ti to the steel in quantities of not more than the stoichiometric ratio with respect to the C content; and these ultra-low carbon BH steel sheets can exhibit the bake hardenability due to residual C in solid solution while maintaining excellent properties specific to ultra-low carbon steel, such as deep drawability, and have been now widely applied to outer panels of automobiles and the like because this type of steel sheet is applicable to zinc or zinc alloy layer coated steel sheets. However, from a practical viewpoint, the BH of this type of steel sheet is reduced to approximately not more than 60 MPa because the steel sheet does not contain a hard second phase which can prevent reappearance of yield point elongation.

Conventionally, numerous improved techniques (for example, Japanese Unexamined Patent Publication No. 57-70258) concerning ultra-low carbon BH steel sheets have been proposed as follows: techniques of continuous annealing at a temperature as high as near 900° C. for elevating the r value by grain growth and raising the BH by redissolving carbide (for example, Japanese Unexamined Patent Publication No. 61-276931); and steel sheet manufacturing techniques aimed at suppressing the reappearance of yield point elongation, similar to the above-mentioned two-phase structure steel, in which a steel sheet is heated to around the $Ac_3$ temperature and then cooled so as to obtain a recrystallized ferrite phase and a high dislocation density ferrite phase transformed from austenite (for example, Japanese Unexamined Patent Publication No. 3-277741).

However, each of these techniques requires annealing at a high temperature of not less than 880° to 900° C., thus they are not only disadvantageous in energy cost and productivity, but also readily form surface defects at press-forming due to coarse grain grown at high temperature annealing. In addition, since the high temperature annealing inevitably reduces the steel sheet's strength, the yield strength of the steel sheet after press-forming is not always high even when the BH is high, therefore a high BH alone does not always contribute to improvement in dent resistance.

SUMMARY OF THE INVENTION

The object of the present invention is to provide a ultra-low carbon BH steel sheet which has substantially nonageing properties at room temperature, excellent formability, and excellent panel appearance after panel-forming, in addition to excellent dent resistance after baking.

The present invention is achieved by the following cold-rolled steel sheets:

A cold-rolled steel sheet 1, comprising a steel composition containing 0.0010 to 0.01 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or two kinds of 0.005 to 0.08 wt % of Nb and 0.01 to 0.07 wt % of Ti in the ranges given by the following formulae (1) and (2):

$$\{(12/93)Nb+(12/48)Ti^*\} \geqq 0.0005 \quad (1)$$

$$0 \leqq C-\{(12/93)Nb+(12/48)Ti^*\} \leqq 0.0015 \quad (2)$$

wherein Ti*=Ti−{(48/32)S+(48/14)N } said cold-rolled steel sheet having a bake hardenability BH of 10 to 35 MPa obtained by 2% tensile prestrain and 170° C.×20 min heat treatment;

said bake hardenability BH (MPa) and a yield strength YP (MPa) of said steel sheet satisfying the following formulae (3*a*) and (4*a*)

$$BH \geqq \exp(-0.115 \cdot YP + 23.0) \quad (3a)$$

$$0.67 \cdot BH + 160 \leqq YP \leqq -0.8 \cdot BH + 280 \quad (4a)$$

A cold-rolled steel sheet 2, comprising a steel composition containing 0.0010 to 0.01 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or two kinds of 0.005 to 0.08 wt % of Nb and 0.01 to 0.07 wt % of Ti in the ranges given by the following formulae (1) and (2):

$$\{(12/93)Nb + (12/48)\mathrm{Ti}^*\} \geqq 0.0005 \quad (1)$$

$$0 \leqq C - \{(12/93)Nb + (12/48)Ti^*\} \leqq 0.0015 \quad (2)$$

wherein Ti*=Ti−{(48/32)S+(48/14)N } said cold-rolled steel sheet having a bake hardenability BH of 10 to 30 MPa obtained by 2% tensile prestrain and 170° C.×20 min heat treatment;

said bake hardenability BH (MPa) and a yield strength YP (MPa) of said steel sheet satisfying the following formulae (3*b*) and (4*b*)

$$BH \geqq \exp(-0.115 \cdot YP + 25.3) \quad (3b)$$

$$0.67 \cdot BH + 177 \leqq YP \leqq -0.8 \cdot BH + 260 \quad (4b)$$

A cold-rolled steel sheet 3, comprising a steel composition containing 0.0010 to 0.0025 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or two kinds of 0.005 to 0.020 wt % of Nb and 0.01 to 0.05 wt % of Ti in the ranges given by the following formulae (1) and (2):

$$\{(12/93)Nb + (12/48)Ti^*\} \geqq 0.0005 \quad (1)$$

$$0 \leqq C - \{(12/93)Nb + (12/48)Ti^*\} \leqq 0.0015 \quad (2)$$

wherein Ti*=Ti−{(48/32)S+(48/14)N } said cold-rolled steel sheet having a bake hardenability BH of 10 to 35 MPa obtained by 2% tensile prestrain and 170° C.×20 min heat treatment;

said bake hardenability BH (MPa) and a yield strength YP (MPa) of said steel sheet satisfying the following formulae (3*a*) and (4*a*)

$$BH \geqq \exp(-0.115 \cdot YP + 23.0) \quad (3a)$$

$$0.67 \cdot BH + 160 \leqq YP \leqq 0.8 \cdot BH + 280 \quad (4a)$$

A cold-rolled steel sheet 4, comprising a steel composition containing 0.0010 to 0.0025 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or two kinds of 0.005 to 0.020 wt % of Nb and 0.01 to 0.05 wt % of Ti in the ranges given by the following formulae (1) and (2):

$$\{(12/93)Nb + (12/48)Ti^*\} \geqq 0.0005 \quad (1)$$

$$0 \leqq C - \{(12/93)Nb + (12/48)Ti^*\} \leqq 0.0015 \quad (2)$$

wherein Ti*=Ti−{(48/32)S+(48/14)N } said cold-rolled steel sheet having a bake hardenability BH of 10 to 30 MPa obtained by 2% tensile prestrain and 170° C.×20 min heat treatment;

said bake hardenability BH (MPa) and a yield strength YP (MPa) of said steel sheet satisfying the following formulae (3*b*) and (4*b*)

$$BH \geqq \exp(-0.115 \cdot YP + 25.3) \quad (3b)$$

$$0.67 \cdot BH + 177 \leqq YP \leqq -0.8 \cdot BH + 260 \quad (4b).$$

It is also possible to achieve the present invention by a cold-rolled steel sheet 1, wherein said steel composition contains 0.0002 to 0.0015 wt % of B or wherein said cold-rolled steel sheet is coated with a zinc or zinc alloy layer.

BRIEF DESCTIPTION OF THE DRAWINGS

Figure 3:
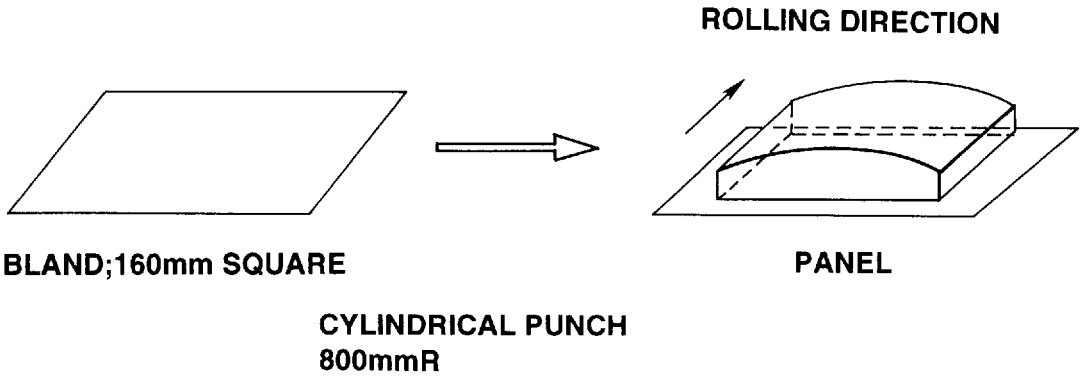
FIG. 3 is a schematic drawing which illustrates a forming method and the shape of a model-panel used for investigation.
Figure 8:
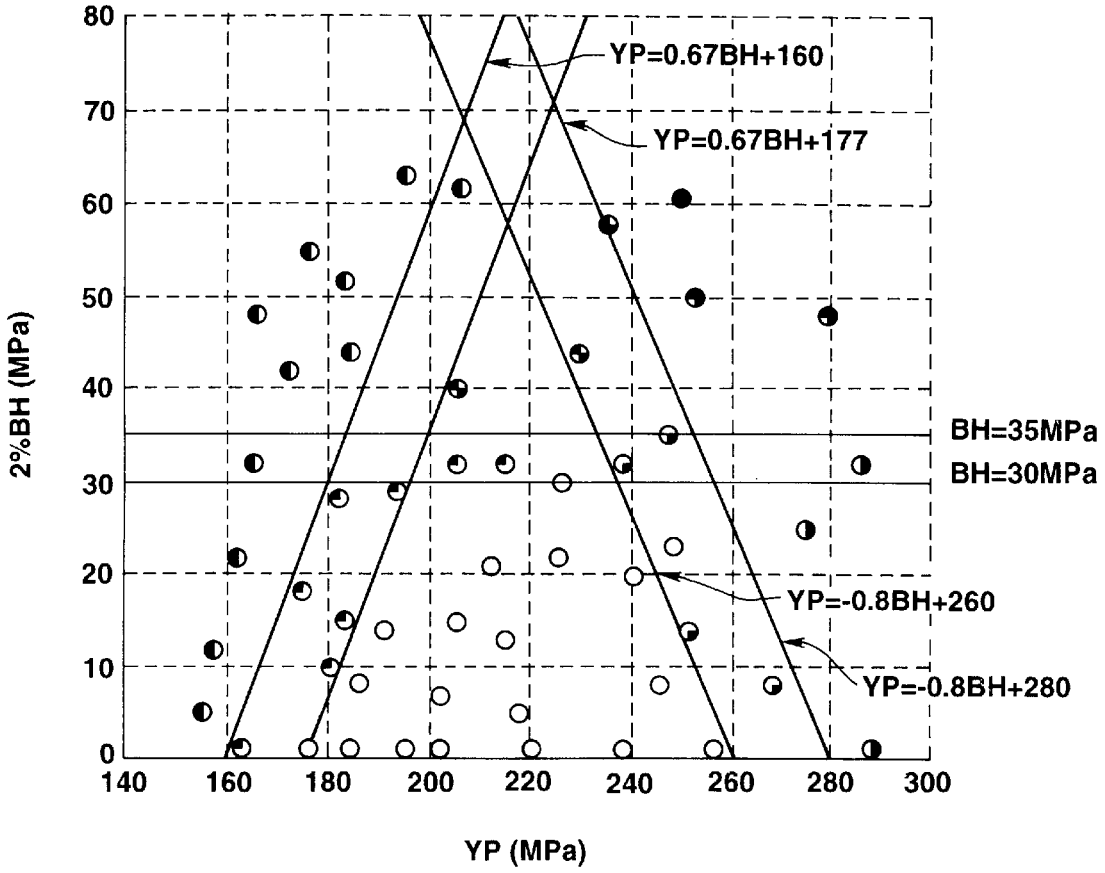

FIG. 8 is a graph which shows the effects of YP and the 2% BH of an ultra-low carbon cold-rolled steel sheet on the changes ( ΔWca) in waviness heights (Wca) measured before and after forming the steel sheet into a model-panel as shown in FIG. 3, followed by baking at 170° C.×20 min and on the surface nonuniformity around a handle when the steel sheet is formed into a model-panel having a bulged part on a flat portion of the panel corresponding to a door handle seat.

DESCRIPTION OF THE PREFERRED EMBODIMENTS

To solve the problems of conventional ultra-low carbon BH steel sheets, the inventors of the present invention have investigated factors controlling dent resistance in detail, and as a result, have had the following findings. In other words, although the bake hardenability was advantageous to some extent in elevating the yield strength of steel sheets, the contribution of the BH to dent resistance was relatively small when the BH of steel sheets was not more than 50 MPa, and on the contrary, the following phenomena were found to have more adverse effects on not only dent resistance but also panel appearance: reduction in the r value or the n value inevitably caused by leaving more than C in solid solution disturbed the flow of steel sheets into the panel face from the flange portion at panel-forming and impeded work-hardening of the steel sheets by uniform strain propagation over the panel face. In other words, contrary to conventional knowledge "to increase the bake hardenability is the best way to improve dent resistance of outer panel of automobiles", it has been apparent that an increase in the bake hardenability does not always lead to improvement in dent resistance. Meanwhile, it was also found that when the bake hardenability was not less than 35 MPa, yield point elongation reappeared during long term storage after temper rolling, resulting in surface defects at panel-forming which are fatal for outer panels, in addition to deterioration of elongation.

In the following, a process to achieve the present invention and characteristics of the present invention will be explained.

Figure 1:
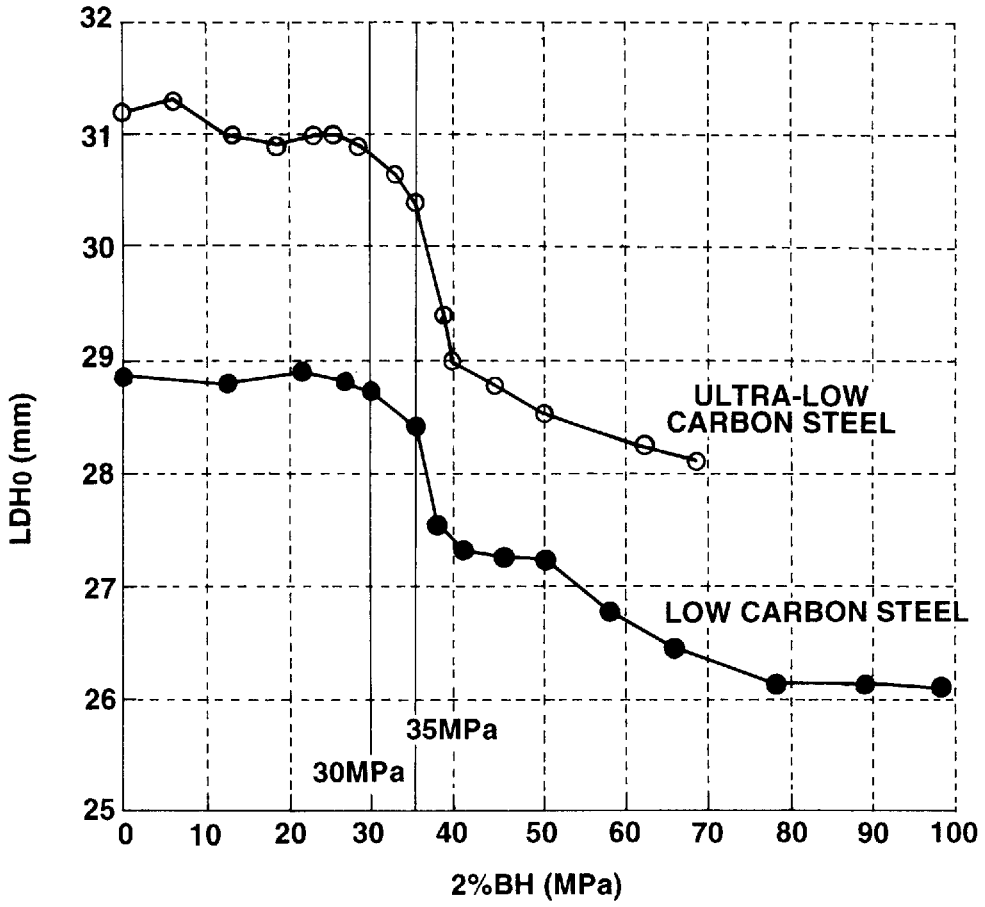
FIG. 1 is a graph which shows the effects of the 2% BH of an ultra-low carbon cold-rolled steel sheet and a low carbon cold-rolled steel sheet on stretchability ($LDH_0$).
Figure 2:
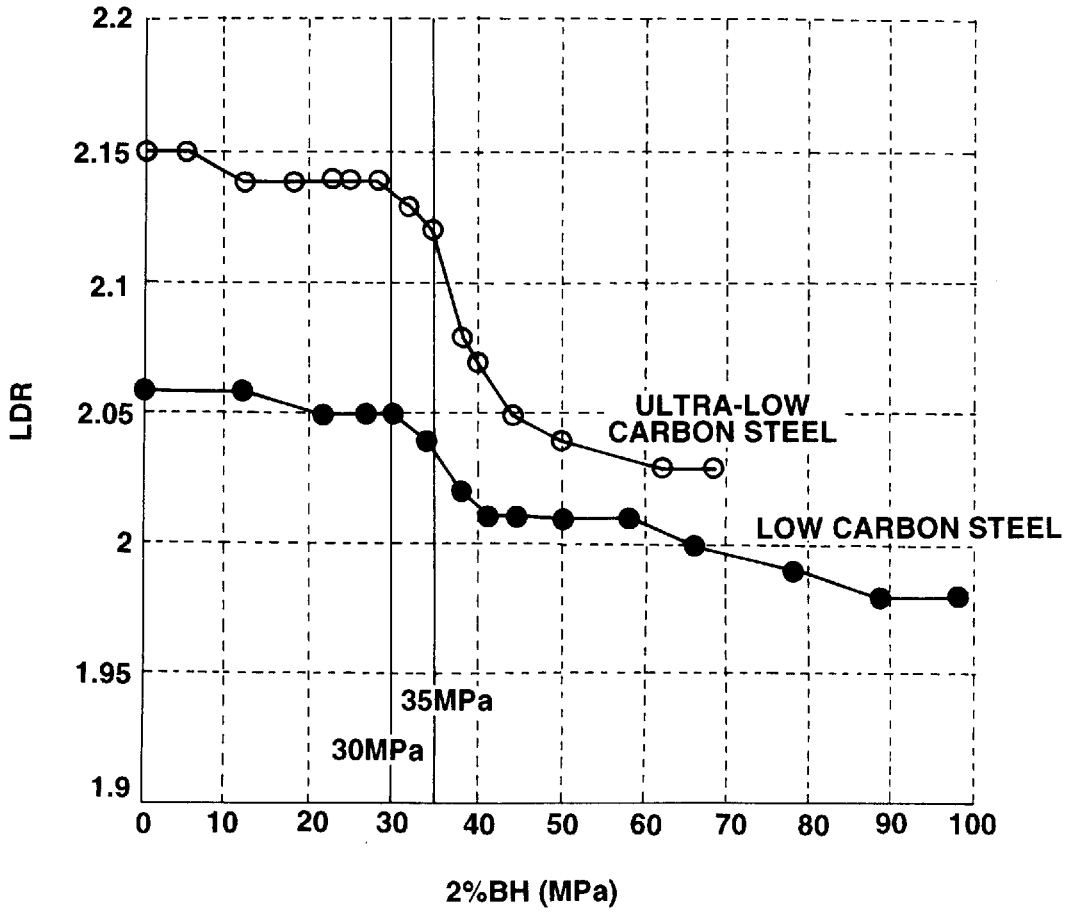
FIG. 2 is a graph which shows the effects of the 2% BH of an ultra-low carbon cold-rolled steel sheet and a low carbon cold-rolled steel sheet on the limiting drawing ratio (LDR).

First, the effects of the 2% BH on formability of steel sheets and surface defects after panel-forming were studied. In this study, 0.7 mm thick ultra-low carbon cold-rolled steel sheets (0.0015 to 0.0042 wt % of C, 0.01 to 0.02 wt % of Si, 0.5 to 0.6 wt % of Mn, 0.03 to 0.04 wt % of P, 0.008 to 0.011 wt % of S, 0.040 to 0.045 wt % of sol. Al, 0.0020 to 0.0024 wt % of N, and 0.005 to 0.012 wt % of Nb) and 0.7 mm thick low carbon cold-rolled steel sheets (0.028 to 0.038 wt % of C, 0.01 wt % of Si, 0.15 to 0.16 wt % of Mn, 0.02 to 0.03 wt % of P, 0.005 to 0.010 wt % of S, 0.035 to 0.042 wt % of sol. Al, and 0.0025 to 0.0030 wt % of N), with different 2% BH, were used. Stretchability and deep drawability were evaluated respectively by $LDH_0$(limiting stretching height) and LDR (limiting drawing ratio) at cylindrical forming of a 50 mm $\phi$ blank. FIGS. 1 and 2 show results thereof.

FIGS. 1 and 2 indicate that a ultra-low carbon BH steel sheet has superior stretchability and deep drawability to a low carbon BH steel sheet. Both $LDH_0$ and LDR of the ultra-low carbon BH steel sheet do not depend on the 2% BH when the 2% BH is not more than 30 MPa, resulting in excellent formability. Furthermore, deterioration in $LDH_0$ and LDR is relatively small in a region regarded as a transition region in which the 2% BH ranges from 30 to 35 MPa. However, when the 2% BH exceeds 35 MPa, both $LDH_0$ and LDR rapidly decrease. These results suggest that reduction in $LDH_0$ due to an increase in the BH of a steel sheet leads to difficulty in uniform propagation of plastic deformation in a high strain region at press-forming and reduction in LDR due to an increase in the BH of a steel sheet results in obstruction of material flow from the flange portion into the panel face, thereby accelerating a decrease in sheet thickness of the panel face or providing nonuniform sheet thickness.

Figure 4:
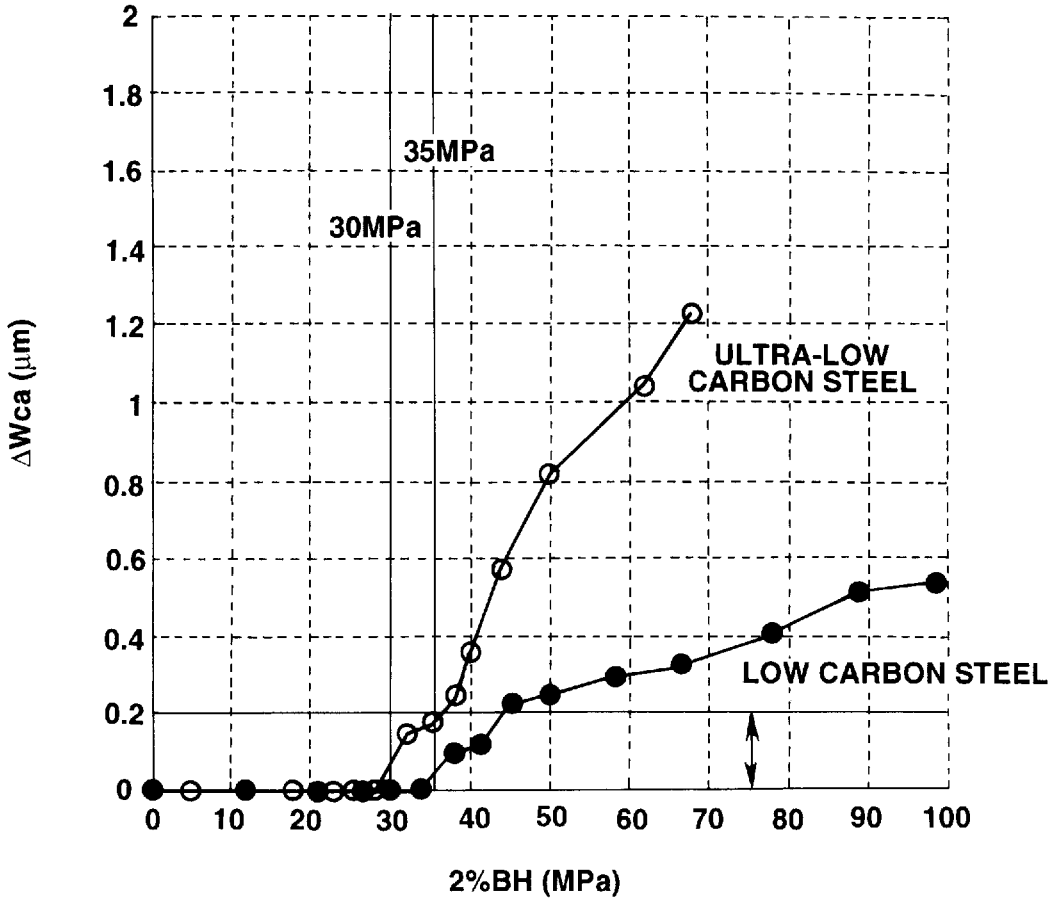
FIG. 4 is a graph which shows the effects of the 2% BH of an ultra-low carbon cold-rolled steel sheet and a low carbon cold-rolled steel sheet, each formed into a model panel as shown in FIG. 3 after artificial ageing at 38° C.×6 months, on the changes ( ΔWca) in waviness heights (Wca) measured before and after panel-forming.

Next, the same steel sheets used in FIGS. 1 and 2 were treated with severe artificial ageing of 38° C.×6 months, panel-formed into a model-panel as shown in FIG. 3, and subjected to surface defect evaluation by measuring changes ($\Delta$Wca) in waviness heights (Wca) before and after panel-forming. FIG. 4 shows the results.

FIG. 4 indicates that even after severe artificial ageing of 38° C.×6 months, the Wca of the panel does not change at all if the BH is not more than 30 MPa. Meanwhile, the Wca of the panel starts increasing if the 2% BH exceeds 30 MPa, and the Wca rapidly increases such that the surface defect can be visually confirmed if the 2% BH exceeds 35 MPa. Particularly in the case of the ultra-low carbon BH steel sheet, surface defect is observed with an elevation in the 2% BH. From a practical viewpoint, the panel appearance after baking has no problem in a range of Wca$\leqq$0.2 $\mu$m, therefore, the 2% BH up to 35 MPa is permissible for obtaining the range of Wca$\leqq$0.2 $\mu$m. In addition, the 2% BH up to 30 MPa is permissible to obtain Wca=0 $\mu$m.

It was understood from the results of FIGS. 1, 2 and 4 that ultra-low carbon BH steel sheets having a 2% BH of not more than 35 MPa, and preferably, not more than 30 MPa exhibit excellent formability and can be panel-formed with excellent appearance. Therefore, in the present invention, the upper limit of 2% BH of ultra-low carbon BH steel sheets is set to 35 MPa, and more preferably, to 30 MPa.

Figure 5:
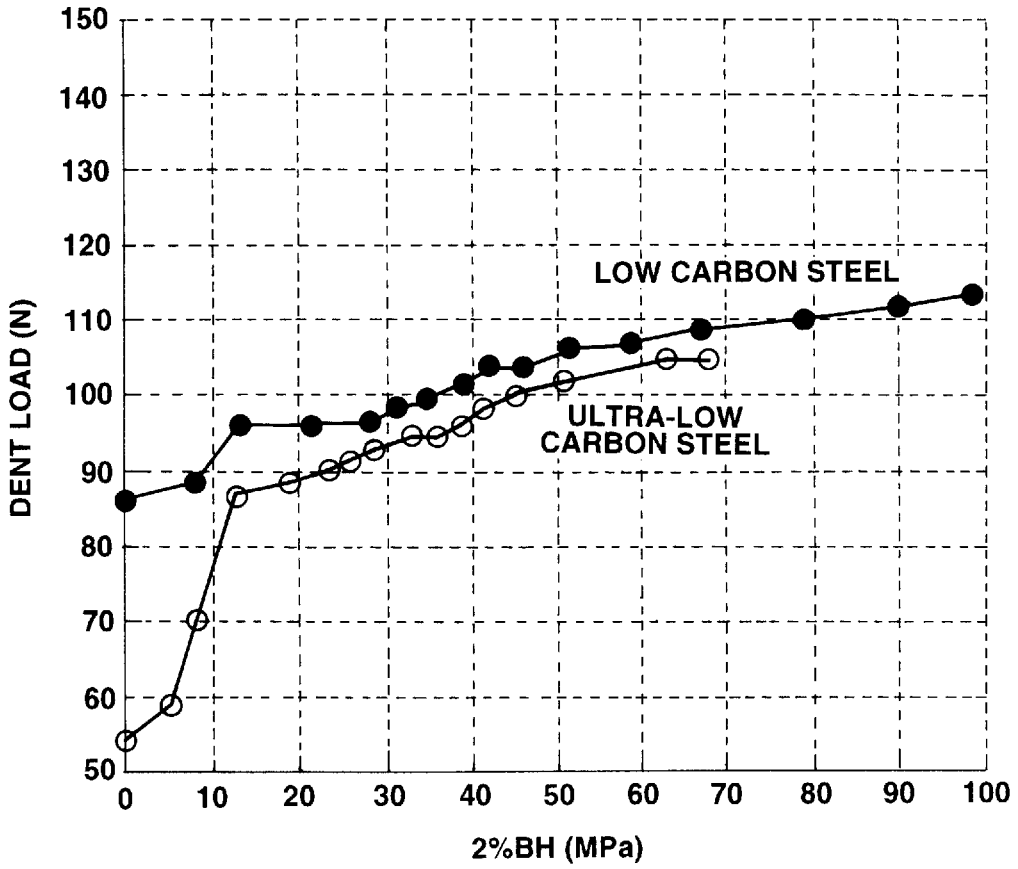
FIG. 5 is a graph which shows the effects of the 2% BH of an ultra-low carbon cold-rolled steel sheet and a low carbon cold-rolled steel sheet on the dent resistance (dent load) of panels.

Meanwhile, the lower limit of 2% BH is set as follows for ultra-low carbon BH steel sheets in the present invention to improve dent resistance immediately after panel-forming. The same steel sheets used in FIGS. 1 and 2 were employed and the 200×200 mm blanks of each steel sheet were panel-formed into a 5 mm high truncated cone by a flat-bottom punch having a diameter of 150 mm and then the dent resistance was evaluated based on the load (dent load) causing a 0.1 mm permanent dent by pushing a 20 mmR ball-point punch on the center of a flat portion of the panel so as to study the effect of 2% BH on dent resistance of the panel immediately after panel-forming. FIG. 5 shows the results.

Conventionally, the BH has been regarded for improving dent resistance in a baking process, however, it was found from the results of FIG. 5 that dent resistance of a panel also depends on the 2% BH of the steel sheet in a region of extremely low 2% BH. In particular, this tendency is remarkably observed in ultra-low carbon steel sheets. Such results suggest that although in ultra-low carbon steel sheets having no BH (such as IF steel) occurs a yield phenomenon by small stresses due to the Bauschinger effect if the steel sheet is deformed in directions different from that of a pre-deformation, this Bauschinger effect in the ultra-low carbon steel sheet having some BH is reduced by a small amount of C in solid solution. In other words, the IF steel is soft and has excellent formability, however, dislocation in ferrite readily moves with a very little obstruction; thus when the stress direction is reversed during a deformation process of the steel sheet, reverse movement or coalescent disappearance of dislocations inside dislocation cells readily occurs in a transition softening region, thereby deteriorating dent resistance. Such steel sheets are not preferable from a viewpoint of dent resistance of the panel immediately after panel-forming, and further, elevation of yield strength after baking cannot be expected at all.

On the other hand, in ultra-low carbon BH steel sheets having a 2% BH of not less than 10 MPa, dent resistance is significantly improved, as is shown in FIG. 5. This phenomenon is considered to be due to the following: in an ultra-low carbon BH steel sheet, a small amount of C in solid solution interacts with dislocations during a pre-deformation process or immediately after deformation so that dislocations are dynamically or statically anchored by the C in solid solution; thus reverse movement or coalescent disappearance of dislocations inside dislocation cells does not readily occur in a transition softening region, resulting in a decreased Bauschinger effect. In particular, dynamic interaction between dislocations and C in solid solution during a pre-deformation stage is considered to contribute to work-hardening of the steel sheet in an initial stage of deformation. Therefore, from a viewpoint of dent resistance of the panel immediately after panel-forming, the assemblability and the like, it is preferable to provide a 2% BH of not less than 10 MPa to steel sheets applied to outer panels of automobiles. Thus, the lower limit of 2% BH for ultra-low carbon BH steel sheets is set to 10 MPa in the present invention.

Figure 6:
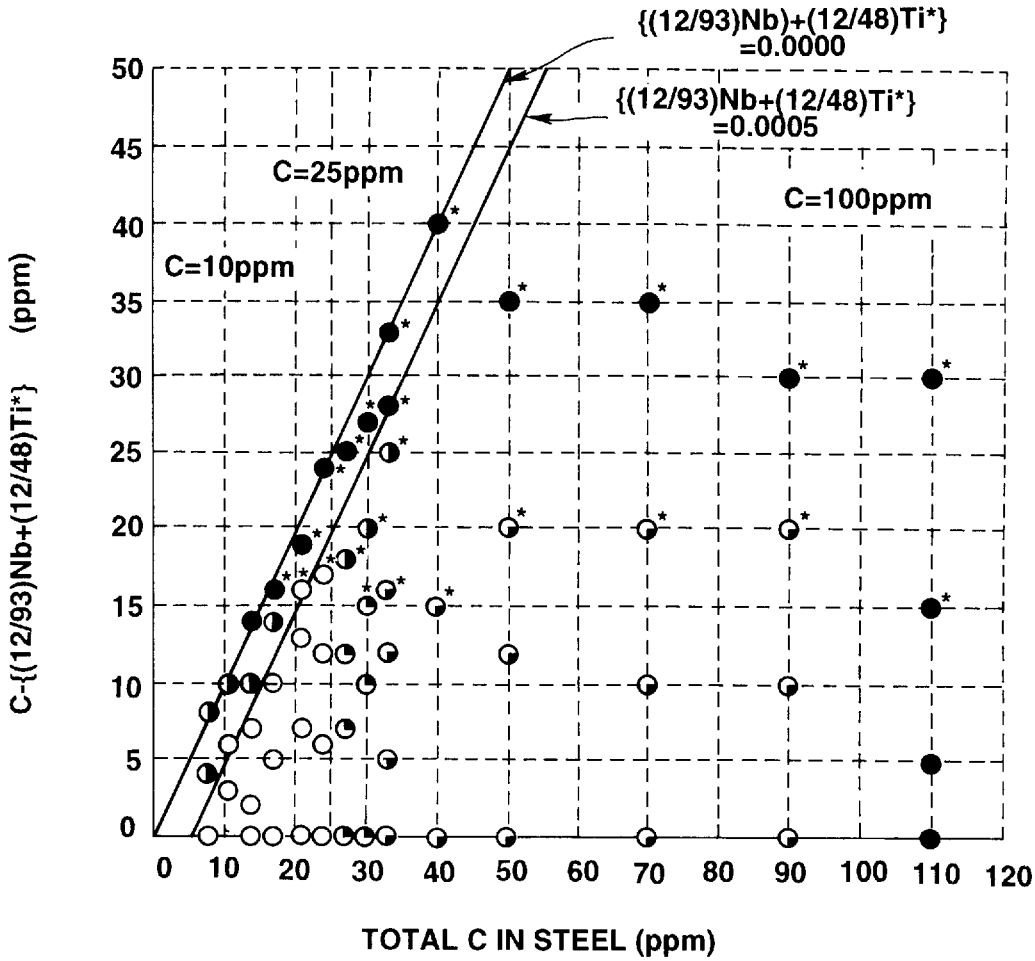
FIG. 6 is a graph shows the effects of C content on the work-hardening exponent n and ΔWca of the steel sheet evaluated at two kinds of strain rates.

An investigation was carried out on work-hardening behavior at two kinds of strain rates in a strain region of not more than 5%, which behavior is regarded to be an important characteristic contributing to dent resistance. FIG. 6 shows the results of a study on the effects of C content on the work-hardening exponent n and the Δ Wca at panel-forming in a small strain region of 0.5 to 2% at a static strain rate of $3\times10^{-3}$/s and at a dynamic strain rate of $3\times10^{-1}$/s similar to the actual press condition, using 0.7 mm thick ultra-low carbon cold-rolled steel sheets containing 0.0005 to 0.011 wt % of C, 0.01 to 0.02 wt % of Si, 0.5 to 0.6 wt % of Mn, 0.03 to 0.04 wt % of P, 0.008 to 0.011 wt % of S, 0.040 to 0.045 wt % of sol. Al, 0.0020 to 0.0024 wt % of N, 0 to 0.08 wt % of Nb, and 0 to 0.07 wt % of Ti.

From FIG. 6, high n values are obtained at a dynamic strain rate of $3\times10^{-1}$/s under such conditions that the total C is not more than 100 ppm, {(12/93)Nb+(12/48)Ti*}, which is a parameter indicating precipitation amount of carbon (which carbon precipitates as NbC or TiC in a ferrite phase) in an equilibrium condition, is not less than 5 ppm, and C−{(12/93)Nb+(12/48)Ti*}, which is a parameter indicating C in solid solution in an equilibrium condition, is not less than 15 ppm, wherein Ti*=Ti− {(48/32)S+(48/14)N }. The high n values are obtained even at a static strain rate of $3\times10^{-3}$/s when the total C is not more than 25 ppm. In the same way as in FIG. 4, the relation Δ Wca≦0.2 μm is obtained when C− {(12/93)Nb+(12/48)Ti*} is not more than 15 ppm. Furthermore, when the above parameters are not less than 0 ppm, BH of not less than 10 MPa can be ensured. Therefore, in ultra-low carbon steel sheets of which steel composition contains one or two kinds of Nb and Ti, it is necessary that Nb and Ti satisfy {(12/93)Nb+(12/48)Ti*}≧0.0005 and 0≦C− {(12/93)Nb+(12/48)Ti*}≦0.0015. Therefore, in the present invention, the contents of Nb and Ti in the steel composition are set to the ranges given by the following formulae (1) and (2):

$$\{(12/93)Nb+(12/48)Ti^*\}\geqq 0.0005 \quad (1)$$

$$0\leqq C-\{(12/93)Nb+(12/48)Ti^*\}\leqq 0.0015 \quad (2)$$

wherein Ti*=Ti− {(48/32)S+(48/14)N}.

Figure 7:
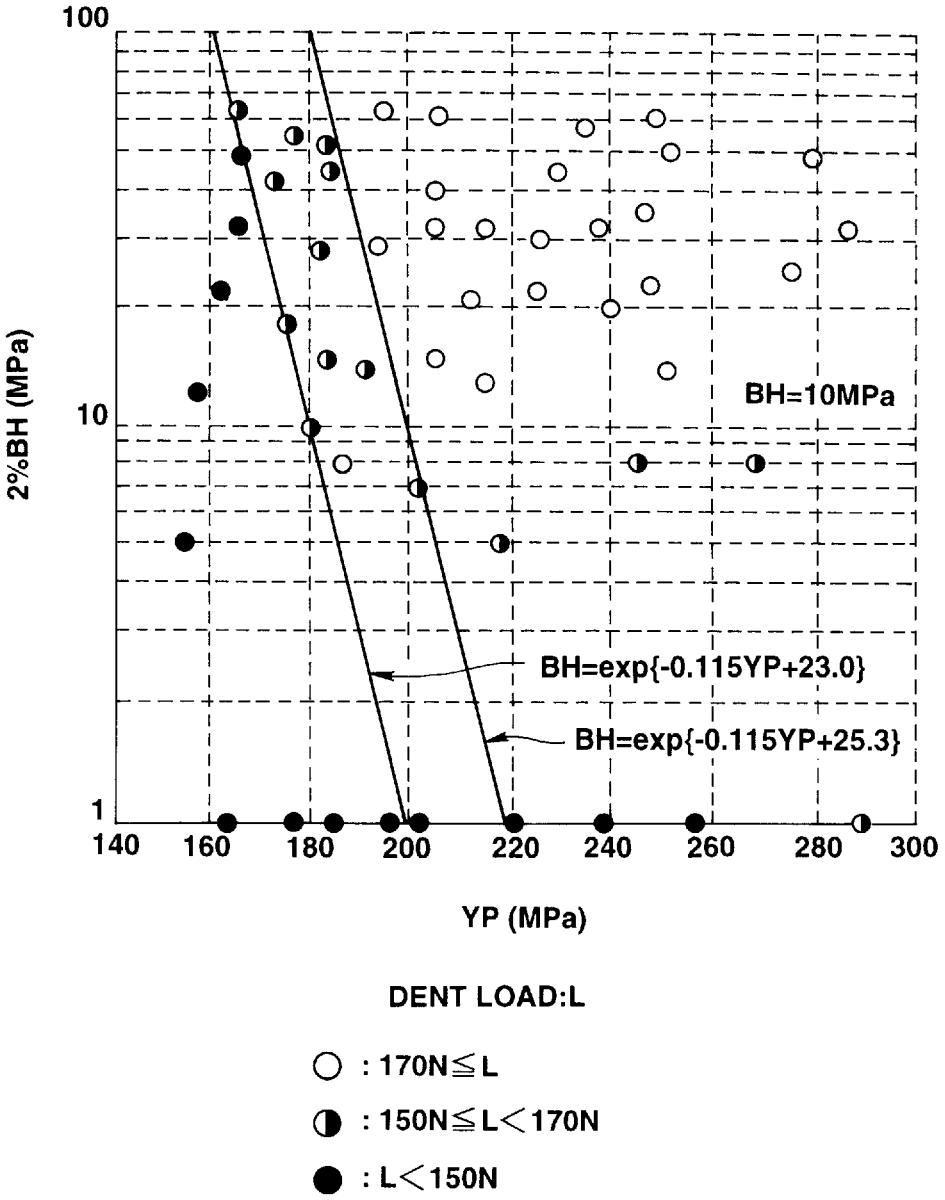
FIG. 7 is a graph shows the effects of YP and the 2% BH of an ultra-low carbon cold-rolled steel sheet on the dent resistance (dent load) of a panel which has been formed into a model-panel as shown in FIG. 3, followed by baking at 170° C.×20 min.

The following investigation was preformed on the most important factors of the present invention, i. e., the yield strength before panel-forming and the 2% BH from a viewpoint of ensuring dent resistance after panel-forming. Ultra-low carbon cold-rolled steel sheets (0.0005 to 0.012 wt % of C, 0.01 to 0.02 wt % of Si, 0.5 to 0.6 wt % of Mn, 0.03 to 0.04 wt % of P, 0.008 to 0.011 wt % of S, 0.040 to 0.045 wt % of sol. Al, 0.0020 to 0.0024 wt % of N, and 0.0020 to 0.08 wt % of Nb) having various yield strength values and 2% BH were panel-formed into a model-panel as shown in FIG. 3, subjected to heat treatment corresponding to a baking process, followed by evaluation of Δ Wca in the center portion of the panel face. In addition, a load (dent load) causing a 0.1 mm permanent dent by pushing a 50 mmR ball-point punch on the center of a flat portion of the panel was measured. Moreover, the same steel sheets were panel-formed into panels having the same shape as that shown in FIG. 3 with a bulge-formed part on its flat portion corresponding to a door handle seat so as to investigate plane strain around the handle. FIGS. 7 and 8 show the results.

FIGS. 7 and 8 indicate that the dent load of a panel is raised by increasing the initial yield strength YP and the 2% BH. With regard to the effect of YP, the dent load rapidly decreases in a region where YP is not more than 170 MPa, thus it is necessary to set the 2% BH to not less than 40 MPa for compensation. Meanwhile, concerning the effect of the 2% BH, the dent load rapidly decreases in a region in which the 2% BH is not more than 10 MPa, and a dent load of not less than 150N cannot be achieved in a substantial nonageing steel sheet having a 2% BH of less than 1 MPa. In a region in which YP is not more than 200 MPa, critical conditions exist between YP and the 2% BH for dent load, and it is necessary to have a 2% BH of BH≧exp(−0.115·YP+23.0) for achieving dent resistance having a dent load of not less than 150N and to have a 2% BH of BH exp(−0.115·YP+25.3) for achieving dent resistance having a dent load of not less than 170N, respectively. Therefore, according to the present invention, the 2% BH (MPa) and the yield strength YP (MPa) of a steel sheet are regulated to satisfy the following formula (3*a*), and preferably, the following formula (3*b*) from a viewpoint of ensuring excellent dent resistance:

$$BH\geqq \exp(-0.115\cdot YP+23.0) \quad (3a)$$

$$BH\geqq \exp(-0.115\cdot YP+25.3) \quad (3b)$$

In addition, it is necessary to set the 2% BH and YP to appropriate values from a viewpoint of excellent panel appearance required for outer panels. Surface defects of a panel become remarkable with a decrease in YP and an increase in the 2% BH, as is shown in FIG. 8. Meanwhile, surface nonuniformity around handle becomes remarkable with an increase in YP and a decrease in the 2% BH. From the above results, concerning the conditions for the 2% BH and YP, a 2% BH of not more than 35 MPa and 0.67·BH+160≦YP≦−0.8·BH+280 are required so as not to have practical problems in surface defects of the panel face or surface nonuniformity around the handle; and a 2% BH of not more than 30 MPa and 0.67·BH+177≦YP≦−0.8·BH+260 are required so as not to have any surface defects of the panel face nor surface nonuniformity around the handle. Therefore, in the present invention, the 2% BH (MPa) and the yield strength YP (MPa) of a steel sheet are regulated to satisfy the following formula (4*a*), and preferably, the following formula (4*b*):

$$0.67\cdot BH+160\leqq YP\leqq -0.8\cdot BH+280 \quad (4a)$$

$$0.67\cdot BH+177\leqq YP\leqq -0.8\cdot BH+260 \quad (4b)$$

The reasons for limiting the composition of steel sheets of the present invention will be explained.

C: As is above-mentioned, in the present invention, it is necessary to set the amounts of fine precipitates such as NbC and TiC precipitating in steel to not less than 5 ppm expressed as the corresponding C amount (equilibrium condition), in addition to ensuring C in solid solution for obtaining a 2% BH of not less than 10 MPa. When the total C in a steel sheet is less than 0.0010 wt %, the required 2% BH cannot be obtained, and meanwhile, if the C exceeds 0.01 wt %, the work-hardening exponent n decreases. Therefore the total C is set from 0.0010 to 0.01 wt %, and preferably not more than 0.0025 wt % for the high n value as above-mentioned.

Si: When an exceedingly large amount of Si is added, chemical conversion treatment properties deteriorate in the case of cold-rolled steel sheets, and adhesion of layer deteriorates in the case of zincor zinc alloy layer coated steel sheets; therefore the amount of Si is set to not more than 0.2 wt % (including 0 wt %).

Mn: Mn is an indispensable element in steel because it serves to prevent hot shortness of a slab by precipitating S as MnS in the steel. In addition, Mn is an element which can solid solution strengthen the steel without deteriorating adhesion of zinc plating layer. However, addition of an exceedingly large amount of Mn is not preferable because it results in a deteriorated r value and an excessively increased yield strength. Therefore, the lower limit of Mn is 0.1 wt % which value is a minimum requirement for precipitating and anchoring S, and the upper limit is 1.5 wt % which value is a limit for avoiding remarkably deteriorated r values and for not exceeding the yield strength of 240 MPa.

P: Since P deteriorates the alloying properties at hot-dip galvanizing and also causes a surface defect on the panel face due to microsegregation of P, the amount of P is preferably as small as possible and set to not more than 0.05 wt % (including 0 wt %).

S: S is included as MnS in steel, and if a steel sheet contains Ti, S precipitates as $Ti_4C_2S_2$ in the steel; since an excess amount of S deteriorates stretch-flangeability and the like, the amount of S is set to not more than 0.02 wt % (including 0 wt %), in which range no problems occur in practical formability or surface treatability.

sol. Al: Sol. Al has a function of precipitating N as AlN in steel and reducing harmful effects due to N in solid solution, which harmful effects decrease the ductility of steel sheets by a dynamic strain ageing, similarly to C in solid solution. When the amount of sol. Al is less than 0.03 wt %, the above effects cannot be achieved, and meanwhile, addition of more than 0.10 wt % of sol. Al does not lead to further effects corresponding to the added amount; therefore the amount of sol. Al is set to 0.03 to 0.10 wt %.

N: Although N is rendered harmless by precipitating as AlN and also precipitating as BN when B is added, the amount of N is preferably as small as possible from a viewpoint of steelmaking techniques, therefore N is set to not more than 0.0040 wt % (including 0 wt %).

Nb and Ti: One or two kinds of 0.005 to 0.08 wt % of Nb and 0.01 to 0.07 wt % of Ti are added to a steel sheet of the present invention as essential elements. These elements are added to steel for controlling the amounts of fine precipitates in the steel such as NbC, TiC, etc. to not less than 5 ppm, which value is expressed by the corresponding C amount in steel (under equilibrium conditions), so as to increase the work-hardening exponent n in an initial deformation stage, and also for anchoring the excess C as NbC or TiC so as to control the amount of residual C in solid solution to not more than 15 ppm. When the added amounts of Nb and Ti are below 0.005 wt % for Nb and 0.01 wt % for Ti respectively, the above-mentioned control of precipitating C cannot be performed appropriately, and meanwhile, if the added amounts of Nb and Ti exceed the 0.08 wt % for Nb and 0.07 wt % for Ti respectivel, it becomes difficult to ensure the C in solid solution required for achieving the desired BH properties. These upper limits are more preferably set to 0.020 wt % for Nb and 0.05 wt % for Ti respectively.

B: Although the above-mentioned composition limitations are sufficient for achieving the present invention, addition of 0.0002 to 0.0015 wt % of B is advantageous in further stabilizing the surface quality and dent resistance. The $Ar_3$ transforming temperature falls due to the addition of B and results in a uniform fine structure over the full length and width of ultra-low carbon hot-rolled steel sheet, and consequently, the surface quality after cold-rolling and annealing is improved; and a small amount of B segregated in ferrite grain boundaries during annealing prevents the C in solid solution from precipitating in grain boundaries during cooling, thus a relatively stable amount of C in solid solution can be left in the steel without high temperature annealing. When the added amount of B is less than 0.0002 wt %, the above-mentioned effects cannot be sufficiently obtained; and meanwhile, formability such as deep drawability deteriorates when the added amount exceeds 0.0015 wt %. Therefore, in the case of adding B, the added amount thereof is set to 0.0002 to 0.0015 wt %.

Balance: Although the balance is substantially composed of Fe, other elements may be added within the limit of not deteriorating the above-mentioned effects of the present invention.

Although steel sheets of the present invention can be used as a cold-rolled sheet, they can be also used as a zinc or a zinc alloy layer coated steel sheet by zincelectroplating or hot-dip galvanizing the cold-rolled steel sheet , and also in this case, the desired surface quality and dent resistance can be obtained after press-forming.

Pure zinc plating, alloyed zinc plating, zinc Ni alloy plating, etc. are employed as the zinc or zinc alloy layer coating, and similar properties can be achieved in steel sheets treated by organic coating after zinc plating.

A example method for manufacturing steel sheets of the present invention will be explained.

A steel sheet of the present invention is manufactured through a series of manufacturing processes including hot-rolling, pickling, cold rolling, annealing, and treated with zinc plating if required. For manufacturing a steel sheet of the present invention, it is preferred that the finishing temperature of the hot-rolling be set to not less than the $Ar_3$ temperature so as to ensure excellent surface quality and uniform properties required for outer panels. In addition, although either of a method of hot-rolling after slab-heating or a method of hot-rolling without slab-heating can be employed for the hot-rolling process, it is preferred that not only the primary scales but also the second scales producing at hot rolling be sufficiently removed for the outer panels. In addition, the preferred coiling temperature after hot-rolling is not more than 680° C., and more preferably, not more than 660° C., from a viewpoints of scale-removal at pickling and stability of the product properties. Furthermore, the preferred lower limit of the coiling temperature is 600° C. for continuous annealing and 540° C. for box annealing so as to avoid adverse effects on a recrystallization texture formation by growing carbide to some extent.

For cold-rolling the hot-rolled steel sheet after scale-removal, it is preferred to set the cold-rolling reduction rate to not less than 70%, and more preferably not less than 75% to achieve the deep-drawability required for outer panels. In addition, when continuous annealing is employed for annealing the cold-rolled steel sheet, the preferred annealing temperature is 780° to 880° C. and more preferably, 780° to 860° C. This is because annealing at temperature of not less than 780° C. is necessary for developing the desired texture for the deep-drawability after recrystallization, and meanwhile, at annealing temperature of more than 860° C., Yp decreases and also remarkable surface defects appear at panel-forming. On the other hand, when box annealing is employed for annealing, a uniform recrystallization structure can be obtained at annealing temperature of not less than 680° C. because of the long soaking time of box annealing, however, the preferred upper limit of the annealing temperature is 750° C. for suppressing grain coarsening.

The annealed cold-rolled steel sheet can be subjected to zinc or zinc alloy layer coating by zincelectroplating or hot-dip galvanizing.

(EXAMPLE 1)

Steels of steel No. 1 to No. 30 each having a composition shown in Tables 1 and 2 were melted and continuously cast into 220 mm thick slabs. These slabs were heated to 1200° C. and then hot-rolled into 2.8 mm thick hot-rolled sheets at finishing temperature of 860° C. (steel No. 1) and 880° to 910° C. (steel Nos. 2 to 30), and at coiling temperature of 540° to 560° C.(for box annealing) and 600° to 640° C.(for continuous annealing and continuous annealing hot-dip galvanizing). These hot-rolled sheets were pickled, cold-rolled to 0.7 mm thickness, followed by one of the following annealing processes: continuous annealing (840° to 860° C.), box annealing (680° to 720° C.), and continuous annealing hot-dip galvanizing (850° to 860° C.). In continuous annealing hot-dip galvanizing, the hot-dip galvanizing was performed at 460° C. after annealing and then the resultant was immediately subjected to alloying treatment in an inline alloying furnace at 500° C. In addition, steel sheets after annealing or annealing hot-dip galvanizing were subjected to temper rolling at a rolling reduction of 1.2%.

The mechanical characteristics of the steel sheets wre measured at a static strain rate of $3\times10^{-3}$/s. The work-hardening exponent n was also measured at a dynamic strain rate of $3\times10^{-1}$/s to evaluate the work-hardening behavior under actual press conditions. And these steel sheets were press-formed to evaluated: $LDH_0$ (limiting stretchability height) and LDR (limiting drawing ratio) by forming cylinders with a diameter of 50 mm; surface defects, plane strain, and dent resistance when formed into a panel as shown in FIG. 3; and further, dent resistance after baking. Tables 3 to 5 show the results thereof.

(EXAMPLE 2)

Steels of steel No. 6, No. 6, No. 12, No. 21, No. 25, and No. 26, each having a composition shown in Tables 1 and 2 were melted and continuously cast into 220 mm thick slabs. These slabs were heated to 1200° C. and then hot-rolled to 2.8 mm thick at finishing temperature of 880° to 900° C. and coiling temperature of 640° to 720° C. These hot-rolled sheets were pickled, cold-rolled to 0.7 mm thickness, and subjected to continuous annealing at 840° to 920° C., followed by temper rolling at a rolling reduction of 1.2%.

These steel sheets were press-formed to evaluated: $LDH_0$ (limiting stretchability height) and LDR (limiting drawing ratio) by forming cylinders with a diameter of 50 mm; surface defects, plane strain, and dent resistance when formed into a panel as shown in FIG. 3; and further, dent resistance after baking. Tables 6 to 7 show the results thereof with characteristic values of steel sheets.

As is mentioned in the above, steel sheets of the present invention have substantial nonageing properties at room temperature, excellent formability, and excellent panel appearance after panel-forming, in addition to excellent dent resistance after baking.

TABLE 1

| Steel | | Composition(wt %) | | | | | | | | | | X | Y |
|---|---|---|---|---|---|---|---|---|---|---|---|---|---|
| No. | Type | C | Si | Mn | P | S | sol.Al | N | Nb | Ti | B | (wt %) | (wt %) |
| 1 | C | 0.031 | 0.01 | 0.15 | 0.023 | 0.012 | 0.036 | 0.0022 | — | — | — | — | — |
| 2 | C | 0.0019 | 0.02 | 0.62 | 0.045 | 0.013 | 0.037 | 0.0019 | — | — | — | — | — |
| 3 | C | 0.0022 | 0.01 | 0.53 | 0.032 | 0.009 | 0.039 | 0.0022 | — | — | 0.0015 | — | — |
| 4 | I | 0.0019 | 0.02 | 0.56 | 0.035 | 0.011 | 0.044 | 0.0021 | 0.006 | — | — | 0.0007 | 0.001 |
| 5 | I | 0.0023 | 0.01 | 0.48 | 0.028 | 0.009 | 0.045 | 0.0018 | 0.011 | — | — | 0.0013 | 0.001 |
| 6 | C | 0.0022 | 0.01 | 0.47 | 0.027 | 0.014 | 0.043 | 0.0018 | 0.021 | — | — | 0.0026 | 0.000 |
| 7 | I | 0.0018 | 0.02 | 0.92 | 0.032 | 0.007 | 0.054 | 0.0016 | 0.009 | — | — | 0.0011 | 0.001 |
| 8 | C | 0.0029 | 0.01 | 0.52 | 0.033 | 0.011 | 0.053 | 0.0015 | 0.011 | — | — | 0.0013 | 0.002 |
| 9 | C | 0.0035 | 0.01 | 0.49 | 0.027 | 0.011 | 0.052 | 0.0023 | 0.015 | — | — | 0.0018 | 0.002 |
| 10 | I | 0.0022 | 0.01 | 0.25 | 0.029 | 0.012 | 0.043 | 0.0025 | 0.009 | — | — | 0.0011 | 0.001 |
| 11 | C | 0.0023 | 0.02 | 0.26 | 0.027 | 0.009 | 0.044 | 0.0025 | 0.022 | — | — | 0.0027 | 0.000 |
| 12 | I | 0.0019 | 0.01 | 1.25 | 0.014 | 0.009 | 0.041 | 0.0024 | 0.015 | — | — | 0.0018 | 0.000 |
| 13 | C | 0.0019 | 0.01 | 0.42 | 0.031 | 0.010 | 0.038 | 0.0026 | 0.022 | — | — | 0.0027 | −0.001 |
| 14 | C | 0.0008 | 0.02 | 0.58 | 0.031 | 0.008 | 0.037 | 0.0022 | 0.011 | — | — | 0.0013 | −0.001 |
| 15 | I | 0.0021 | 0.02 | 0.43 | 0.034 | 0.012 | 0.042 | 0.0021 | 0.011 | — | 0.0008 | 0.0013 | 0.001 |
| 16 | C | 0.0029 | 0.01 | 0.41 | 0.035 | 0.015 | 0.045 | 0.0019 | 0.011 | — | 0.0009 | 0.0013 | 0.002 |
| 17 | C | 0.0038 | 0.01 | 0.42 | 0.036 | 0.014 | 0.048 | 0.0020 | 0.018 | — | 0.0007 | 0.0022 | 0.002 |

I: Invention, C: Comparison
X: (12/93)Nb + (12/48)Ti*
Y: C-{(12/93)Nb + (12/48)Ti*}
Ti: Ti-{(48/32)S + (48/14)N}

TABLE 2

| Steel | | Composition(wt %) | | | | | | | | | | X | Y |
|---|---|---|---|---|---|---|---|---|---|---|---|---|---|
| No. | Type | C | Si | Mn | P | S | sol.Al | N | Nb | Ti | B | (wt %) | (wt %) |
| 18 | I | 0.0050 | 0.02 | 0.35 | 0.042 | 0.010 | 0.051 | 0.0022 | 0.029 | — | — | 0.0037 | 0.0013 |
| 19 | I | 0.0070 | 0.01 | 0.66 | 0.025 | 0.011 | 0.041 | 0.0019 | 0.046 | — | — | 0.0059 | 0.0011 |
| 20 | C | 0.0090 | 0.01 | 0.51 | 0.033 | 0.012 | 0.047 | 0.0020 | 0.054 | — | — | 0.0070 | 0.0020 |
| 21 | C | 0.0120 | 0.02 | 0.37 | 0.028 | 0.010 | 0.055 | 0.0023 | 0.08 | — | — | 0.0103 | 0.0017 |
| 22 | I | 0.0021 | 0.01 | 0.52 | 0.039 | 0.009 | 0.048 | 0.0018 | — | 0.023 | — | 0.0008 | 0.0013 |
| 23 | I | 0.0021 | 0.02 | 0.53 | 0.038 | 0.012 | 0.045 | 0.0028 | — | 0.032 | — | 00011 | 00010 |
| 24 | I | 0.0022 | 0.01 | 0.53 | 0.039 | 0.018 | 0.052 | 0.0039 | — | 0.045 | — | 0.0012 | 0.0010 |
| 25 | C | 0.0021 | 0.02 | 0.49 | 0.035 | 0.015 | 0.053 | 0.0025 | — | 0.066 | — | 0.0087 | −0.0066 |
| 26 | C | 0.0037 | 0.01 | 0.45 | 0.034 | 0.011 | 0.053 | 0.0024 | — | 0.055 | — | 0.0076 | −0.0039 |
| 27 | I | 0.0023 | 0.01 | 0.48 | 0.025 | 0.012 | 0.044 | 0.0022 | 0.009 | 0.025 | — | 0.0010 | 0.0013 |

TABLE 2-continued

| Steel | | Composition(wt %) | | | | | | | | | | X | Y |
|---|---|---|---|---|---|---|---|---|---|---|---|---|---|
| No. | Type | C | Si | Mn | P | S | sol.Al | N | Nb | Ti | B | (wt %) | (wt %) |
| 28 | C | 0.0035 | 0.01 | 0.49 | 0.027 | 0.013 | 0.043 | 0.0024 | 0.012 | 0.038 | — | 0.0040 | −0.0005 |
| 29 | C | 0.0019 | 0.02 | 0.52 | 0.025 | 0.009 | 0.042 | 0.0018 | 0.023 | 0.024 | — | 0.0039 | −0.0020 |
| 30 | I | 0.0019 | 0.01 | 0.53 | 0.024 | 0.009 | 0.066 | 0.0017 | 0.014 | 0.018 | — | 0.0014 | 0.0005 |
| 31 | I | 0.0085 | 0.01 | 0.37 | 0.030 | 0.01 | 0.051 | 0.0018 | 0.04 | 0.03 | — | 0.0074 | 0.0011 |
| 32 | I | 0.0024 | 0.01 | 0.43 | 0.032 | 0.011 | 0.062 | 0.0026 | — | 0.033 | 0.0009 | 0.0019 | 0.0005 |
| 33 | C | 0.0029 | 0.01 | 0.42 | 0.033 | 0.012 | 0.054 | 0.0024 | — | 0.052 | 0.0007 | 0.0064 | −0.0035 |
| 34 | I | 0.0021 | 0.02 | 0.38 | 0.023 | 0.008 | 0.052 | 0.0019 | 0.009 | 0.018 | 0.0005 | 0.0010 | 0.0011 |
| 35 | C | 0.0033 | 0.02 | 0.39 | 0.022 | 0.011 | 0.055 | 0.0016 | 0.011 | 0.022 | 0.0007 | 0.0014 | 0.0019 |

TABLE 3

| | | | Mechanical properties | | | | | | | | | Dent load |
|---|---|---|---|---|---|---|---|---|---|---|---|---|
| | | | | | Work-hardening exponent:n | | Formabilities | | Panel performance | | | after |
| No. | Steel No. | Annealing | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 1 | 1 | CAL | 238 | 56 | 0.159 | 0.162 | 26.8 | 1.98 | Inferior | 0 | 112 | 185 |
| 2 | | BAF | 231 | 0 | 0.183 | 0.186 | 28.3 | 2.05 | None | 0 | 101 | 172 |
| 3 | | CGL | 242 | 63 | 0.145 | 0.153 | 26.7 | 1.96 | Inferior | 0 | 113 | 184 |
| 4 | 2 | CAL | 182 | 31 | 0.194 | 0.196 | 29.3 | 2.01 | None | 0.6 | 89 | 162 |
| 5 | | BAF | 163 | 12 | 0.213 | 0.211 | 30.5 | 2.09 | None | 0.8 | 65 | 141 |
| 6 | | CGL | 185 | 34 | 0.175 | 0.177 | 28.7 | 1.99 | None | 0.6 | 90 | 165 |
| 7 | 3 | CAL | 189 | 18 | 0.179 | 0.183 | 29.8 | 2.04 | None | 0 | 93 | 159 |
| 8 | 4 | CAL | 208 | 25 | 0.262 | 0.266 | 31.4 | 2.14 | None | 0 | 95 | 175 |
| 9 | | CGL | 210 | 28 | 0.249 | 0.255 | 31.2 | 2.13 | None | 0 | 96 | 176 |
| 10 | 5 | CAL | 217 | 22 | 0.275 | 0.273 | 30.9 | 2.13 | None | 0 | 92 | 178 |
| 11 | | BAF | 208 | 17 | 0.262 | 0.263 | 30.1 | 2.91 | None | 0 | 88 | 172 |
| 12 | | CGL | 218 | 26 | 0.256 | 0.261 | 30.8 | 2.13 | None | 0 | 92 | 177 |
| 13 | 6 | CAL | 203 | 0 | 0.237 | 0.197 | 31.1 | 2.16 | None | 0 | 58 | 145 |
| 14 | | BAF | 198 | 0 | 0.223 | 0.216 | 30.5 | 2.15 | None | 0 | 69 | 139 |
| 15 | | CGL | 205 | 0 | 0.231 | 0.193 | 31 | 2.15 | None | 0 | 57 | 143 |
| 16 | 7 | CAL | 235 | 16 | 0.269 | 0.271 | 31.4 | 2.15 | None | 0 | 89 | 183 |
| 17 | | CGL | 234 | 19 | 0.252 | 0.256 | 31.2 | 2.14 | None | 0 | 92 | 184 |
| 18 | 8 | CAL | 238 | 37 | 0.227 | 0.252 | 29.5 | 2.08 | Permissive | 0.2 | 94 | 179 |
| 19 | 9 | CAL | 247 | 39 | 0.195 | 0.251 | 29 | 2.06 | Permissive | 0.2 | 96 | 181 |
| 20 | 10 | CAL | 196 | 28 | 0.267 | 0.265 | 30.9 | 2.15 | None | 0 | 95 | 174 |
| 21 | | CGL | 193 | 24 | 0.253 | 0.259 | 30.8 | 2.14 | None | 0 | 95 | 175 |

CAL: Continuous annealing
BAF: Box annealing
CGL : Continuous annealing hot-dip galvanizing

TABLE 4

| | | | Mechanical properties | | | | | | | | | Dent load |
|---|---|---|---|---|---|---|---|---|---|---|---|---|
| | | | | | Work-hardening exponent:n | | Formabilities | | Panel performance | | | after |
| No. | Steel No. | Annealing | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 22 | 11 | CAL | 184 | 13 | 0.242 | 0.246 | 30.3 | 2.16 | None | 0 | 90 | 165 |
| 23 | | CGL | 185 | 14 | 0.235 | 0.230 | 29.7 | 2.14 | None | 0 | 91 | 168 |
| 24 | 12 | CAL | 238 | 11 | 0.259 | 0.261 | 31.4 | 2.17 | None | 0 | 88 | 186 |
| 25 | | CGL | 237 | 13 | 0.253 | 0.244 | 31.3 | 2.15 | None | 0 | 90 | 186 |
| 26 | 13 | CAL | 180 | 0 | 0.242 | 0.253 | 31.5 | 2.18 | None | 0 | 60 | 145 |
| 27 | 14 | CAL | 170 | 0 | 0.248 | 0.261 | 31.8 | 2.19 | None | 0.2 | 54 | 126 |
| 28 | 15 | CAL | 205 | 23 | 0.265 | 0.263 | 30.9 | 2.14 | None | 0.1 | 96 | 179 |
| 29 | | CGL | 205 | 25 | 0.247 | 0.245 | 30.6 | 2.13 | None | 0 | 98 | 175 |
| 30 | 16 | CAL | 235 | 37 | 0.243 | 0.198 | 29.4 | 2.09 | Permissive | 0.2 | 101 | 177 |
| 31 | | CGL | 238 | 38 | 0.237 | 0.197 | 29.2 | 2.05 | Permissive | 0.2 | 104 | 177 |
| 32 | 17 | CAL | 250 | 40 | 0.195 | 0.251 | 28.8 | 2.04 | Inferior | 0.4 | 107 | 179 |
| 33 | 18 | CAL | 233 | 31 | 0.197 | 0.251 | 29.8 | 2.11 | None | 0 | 98 | 183 |
| 34 | | CGL | 231 | 30 | 0.195 | 0.253 | 29.9 | 2.1 | None | 0 | 96 | 180 |
| 35 | 19 | CAL | 235 | 27 | 0.195 | 0.253 | 30.1 | 2.13 | None | 0 | 105 | 176 |
| 36 | | CGL | 235 | 25 | 0.196 | 0.252 | 30 | 2.11 | None | 0 | 103 | 172 |
| 37 | 20 | CAL | 249 | 43 | 0.183 | 0.190 | 29.5 | 2.07 | Inferior | 0.4 | 109 | 185 |
| 38 | | CGL | 253 | 41 | 0.180 | 0.192 | 29.3 | 2.07 | Inferior | 0.4 | 110 | 183 |
| 39 | 21 | CAL | 261 | 39 | 0.181 | 0.189 | 29.1 | 2.05 | Inferior | 0.2 | 113 | 185 |

TABLE 4-continued

| | | | Mechanical properties | | | | | | | | | Dent load |
|---|---|---|---|---|---|---|---|---|---|---|---|---|
| | | | | | Work-hardening exponent:n | | Formabilities | | Panel performance | | | after |
| No. | Steel No. | Annealing | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 40 | 22 | CAL | 205 | 30 | 0.274 | 0.271 | 31.6 | 2.16 | None | 0 | 91 | 172 |
| 41 | 23 | CAL | 213 | 25 | 0.269 | 0.270 | 31.5 | 2.16 | None | 0 | 92 | 173 |

TABLE 5

| | | | Mechanical properties | | | | | | | | | Dent load |
|---|---|---|---|---|---|---|---|---|---|---|---|---|
| | | | | | Work-hardening exponent:n | | Formabilities | | Panel performance | | | after |
| No. | Steel No. | Annealing | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 42 | 24 | CAL | 221 | 24 | 0.265 | 0.261 | 31.2 | 2.15 | None | 0 | 95 | 175 |
| 43 | | CGL | 222 | 26 | 0.251 | 0.253 | 30.8 | 2.14 | None | 0 | 94 | 175 |
| 44 | 25 | CAL | 201 | 0 | 0.248 | 0.237 | 30.5 | 2.17 | None | 0 | 60 | 147 |
| 45 | 26 | CAL | 215 | 0 | 0.229 | 0.227 | 30.2 | 2.14 | None | 0 | 62 | 149 |
| 46 | 27 | CAL | 221 | 31 | 0.267 | 0.265 | 30.4 | 2.15 | None | 0.1 | 92 | 173 |
| 47 | 28 | CAL | 203 | 0 | 0.193 | 0.200 | 30.1 | 2.14 | None | 0 | 79 | 148 |
| 48 | 29 | CAL | 195 | 0 | 0.245 | 0.243 | 31.3 | 2.16 | None | 0 | 75 | 147 |
| 49 | | CGL | 194 | 0 | 0.252 | 0.239 | 31.2 | 2.15 | None | 0 | 74 | 146 |
| 50 | 30 | CAL | 205 | 15 | 0.262 | 0.260 | 30.9 | 2.15 | None | 0 | 90 | 173 |
| 51 | | CGL | 207 | 15 | 0.258 | 0.255 | 30.7 | 2.13 | None | 0 | 92 | 174 |
| 52 | 31 | CAL | 237 | 27 | 0.197 | 0.256 | 30.2 | 2.14 | None | 0 | 98 | 183 |
| 53 | | CGL | 236 | 28 | 0.198 | 0.254 | 30.0 | 2.13 | None | 0 | 94 | 180 |
| 54 | 32 | CAL | 213 | 17 | 0.253 | 0.256 | 30.8 | 2.11 | None | 0 | 93 | 175 |
| 55 | 33 | CAL | 203 | 0 | 0.215 | 0.180 | 30.4 | 2.13 | None | 0 | 75 | 149 |
| 56 | 34 | CAL | 235 | 24 | 0.256 | 0.253 | 29.8 | 2.11 | None | 0 | 104 | 182 |
| 57 | | CGL | 234 | 26 | 0.251 | 0.256 | 29.7 | 2.1 | None | 0 | 108 | 180 |
| 58 | 35 | CAL | 246 | 40 | 0.212 | 0.192 | 27.9 | 2.16 | Permissive | 0.2 | 106 | 187 |
| 59 | | CGL | 252 | 42 | 0.205 | 0.194 | 27.8 | 2.13 | Inferior | 0.2 | 110 | 189 |

TABLE 6

| | | | | Mechanical properties | | | | | | | | | Dent load |
|---|---|---|---|---|---|---|---|---|---|---|---|---|---|
| | | Coiling | Annealing | | | Work-hardening exponent:n | | Formabilities | | Panel performance | | | after |
| No. | Steel No. | temp. (°C.) | temp. (°C.) | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 60 | 5 | 680 | 840 | 216 | 21 | 0.272 | 0.27 | 31.1 | 2.16 | None | 0 | 90 | 173 |
| 61 | 5 | 640 | 840 | 217 | 22 | 0.275 | 0.273 | 30.9 | 2.13 | None | 0 | 92 | 178 |
| 62 | 5 | 640 | 880 | 209 | 24 | 0.273 | 0.272 | 31.2 | 2.15 | None | 0 | 89 | 170 |
| 63 | 5 | 720 | 880 | 178 | 32 | 0.263 | 0.266 | 29.5 | 2.17 | None | 0.4 | 80 | 161 |
| 64 | 5 | 640 | 920 | 250 | 42 | 0.243 | 0.243 | 28.7 | 2.01 | Inferior | 0 | 102 | 183 |
| 65 | 6 | 640 | 840 | 203 | 0 | 0.237 | 0.197 | 31.1 | 2.16 | None | 0 | 58 | 145 |
| 66 | 6 | 640 | 860 | 201 | 5 | 0.236 | 0.195 | 31.4 | 2.18 | None | 0 | 64 | 148 |
| 67 | 6 | 640 | 880 | 198 | 18 | 0.244 | 0.188 | 31.7 | 2.2 | None | 0.3 | 72 | 146 |
| 68 | 6 | 700 | 880 | 175 | 17 | 0.240 | 0.196 | 30.8 | 2.22 | None | 0.8 | 68 | 144 |
| 69 | 12 | 640 | 860 | 238 | 11 | 0.259 | 0.261 | 31.4 | 2.17 | None | 0 | 88 | 186 |
| 70 | 12 | 640 | 880 | 231 | 20 | 0.257 | 0.258 | 31.6 | 2.2 | None | 0 | 86 | 181 |
| 71 | 12 | 640 | 920 | 275 | 32 | 0.198 | 0.232 | 28.9 | 1.98 | Inferior | 0.2 | 115 | 191 |
| 72 | 25 | 640 | 860 | 201 | 0 | 0.248 | 0.237 | 30.5 | 2.17 | None | 0 | 60 | 147 |

TABLE 7

| | | | | Mechanical properties | | | | | | | | | Dent load |
|---|---|---|---|---|---|---|---|---|---|---|---|---|---|
| | | Coiling | Annealing | | | Work-hardening exponent:n | | Formabilities | | Panel performance | | | after |
| No. | Steel No. | temp. (°C.) | temp. (°C.) | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 73 | 25 | 640 | 880 | 197 | 15 | 0.246 | 0.233 | 30.8 | 2.2 | None | 0.3 | 68 | 148 |
| 74 | 25 | 640 | 900 | 181 | 28 | 0.249 | 0.236 | 29.8 | 2.21 | Permissive | 0.6 | 70 | 149 |

TABLE 7-continued

| | | | | Mechanical properties | | | | | | | | | Dent load |
|---|---|---|---|---|---|---|---|---|---|---|---|---|---|
| | | Coiling | Annealing | | | Work-hardening exponent:n | | Formabilities | | Panel performance | | | after |
| No. | Steel No. | temp. (°C.) | temp. (°C.) | YP (MPa) | BH (MPa) | Strain rate :3 × 10-3/s | Strain rate :3 × 10-1/s | LDH0 (mm) | LDR | Plane strain | ΔWca (μm) | Dent load (N) | baking (N) |
| 75 | 25 | 680 | 860 | 198 | 0 | 0.247 | 0.219 | 30.9 | 2.18 | Permissive | 0 | 59 | 145 |
| 76 | 29 | 640 | 860 | 195 | 0 | 0.245 | 0.243 | 31.3 | 2.16 | None | 0 | 75 | 147 |
| 77 | 29 | 640 | 880 | 188 | 13 | 0.249 | 0.245 | 31.1 | 2.18 | None | 0.3 | 74 | 149 |
| 78 | 29 | 640 | 900 | 183 | 15 | 0.243 | 0.24 | 30.4 | 2.05 | None | 0.7 | 71 | 142 |
| 79 | 29 | 680 | 860 | 193 | 0 | 0.244 | 0.237 | 31.6 | 2.19 | None | 0 | 73 | 145 |
| 80 | 30 | 640 | 860 | 205 | 15 | 0.262 | 0.26 | 30.9 | 2.15 | None | 0 | 90 | 173 |
| 81 | 30 | 680 | 880 | 202 | 20 | 0.268 | 0.257 | 31.2 | 2.18 | None | 0 | 91 | 176 |
| 82 | 30 | 680 | 860 | 201 | 13 | 0.26 | 0.252 | 30.7 | 2.17 | None | 0 | 90 | 171 |
| 83 | 30 | 700 | 880 | 172 | 22 | 0.271 | 0.254 | 30.4 | 2.21 | None | 0.4 | 77 | 148 |
| 84 | 31 | 640 | 840 | 237 | 27 | 0.197 | 0.256 | 30.2 | 2.14 | None | 0 | 98 | 183 |
| 85 | 31 | 680 | 860 | 230 | 28 | 0.199 | 0.253 | 30.5 | 2.17 | None | 0 | 94 | 180 |
| 86 | 31 | 680 | 880 | 220 | 31 | 0.195 | 0.251 | 30.1 | 2.02 | None | 0 | 99 | 182 |
| 87 | 31 | 700 | 900 | 246 | 38 | 0.188 | 0.238 | 28.6 | 2.00 | Permissive | 0.2 | 102 | 187 |

What is claimed is:

1. A cold-rolled steel sheet for excellent panel appearance and dent resistance after panel-forming, comprising a steel composition containing 0.0010 to 0.01 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or both of 0.005 to 0.08 wt % of Nb and 0.01 to 0.07 wt % of Ti in the ranges given by the following formulae (1) and (2):

$$\{(12/93)Nb+(12/48)Ti^*\}\geqq 0.0005 \quad (1)$$

$$0\leqq C-\{(12/93)Nb+(12/48)Ti^*\}\leqq 0.0015 \quad (2)$$

wherein Ti*=Ti−{(48/32)S+(48/14)N} said cold-rolled steel sheet having a bake hardenability BH of 10 to 35 MPa obtained by a 2% tensile prestrain and 170° C.×20 min heat treatment;

said bake hardenability BH (MPa) and a yield strength YP (MPa) of said steel sheet satisfying the following formulae (3*a*) and (4*a*)

$$BH\geqq \exp(-0.115\cdot YP+23.0) \quad (3a)$$

$$0.67\cdot BH+160\leqq YP\leqq -0.8\cdot BH+280 \quad (4a).$$

2. A cold-rolled steel sheet for excellent panel appearance and dent resistance after panel-forming, comprising a steel composition containing 0.0010 to 0.01 wt % of C, 0 to 0.2 wt % of Si, 0.1 to 1.5 wt % of Mn, 0-to 0.05 wt % of P, 0 to 0.02 wt % of S, 0.03 to 0.10 wt % of sol. Al, and 0 to 0.0040 wt % of N, and further containing one or both of 0.005 to 0.08 wt % of Nb and 0.01 to 0.07 wt % of Ti in the ranges given by the following formulae (1) and (2):

$$\{(12/93)Nb+(12/48)Ti^*\}\geqq 0.0005 \quad (1)$$

$$0\leqq C-\{(12/93)Nb+(12/48)Ti^*\}\leqq 0.0015 \quad (2)$$

wherein Ti*=Ti−{(48/32)S+(48/14)N} said cold-rolled steel sheet having a bake hardenability BH of 10 to 30 MPa obtained by 2% tensile prestrain and 170° C.×20 min heat treatment;

said bake hardenability BH (MPa) and a yield strength YP (MPa) of said steel sheet satisfying the following formulae (3*b*) and (4*b*)

$$BH\geqq \exp(-0.115\cdot YP+25.3) \quad (3b)$$

$$0.67\cdot BH+177\leqq YP\leqq -0.8\cdot BH+260 \quad (4b).$$

3. A cold-rolled steel sheet for excellent panel appearance and dent resistance after panel-forming, comprising a steel composition containing 0.0010 to 0.0025 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one or both of 0.005 to 0.020 wt % of Nb and 0.01 to 0.05 wt % of Ti in the ranges given by the following formulae (1) and (2):

$$\{(12/93)Nb+(12/48)Ti^*\}\geqq 0.0005 \quad (1)$$

$$0\leqq C-\{(12/93)Nb+(12/48)Ti^*\}\leqq 0.0015 \quad (2)$$

wherein Ti*=Ti−{(48/32)S+(48/14)N} said cold-rolled steel sheet having a bake hardenability BH of 10 to 35 MPa obtained by a 2% tensile prestrain and 170° C.×20 min heat treatment;

said bake hardenability BH (MPa) and a yield strength YP (MPa) of said steel sheet satisfying the following formulae (3*a*) and (4*a*)

$$BH\geqq \exp(-0.115\cdot YP+23.0) \quad (3a)$$

$$0.67\cdot BH+160\leqq YP\leqq -0.8\cdot -BH+280 \quad (4a).$$

4. A cold-rolled steel sheet for excellent panel appearance and dent resistance after panel-forming, comprising a steel composition containing 0.0010 to 0.0025 wt % of C, 0 to 0.2 wt % of Si, 0.1 to 1.5 wt % of Mn, 0 to 0.05 wt % of P, 0 to 0.02 wt % of S, 0.03 to 0.10 wt % of sol. Al, and 0 to 0.0040 wt % of N, and further containing one. or both of 0.005 to 0.020 wt % of Nb and 0.01 to 0.05 wt % of Ti in the ranges given by the following formulae (1) and (2):

$$\{(12/93)Nb+(12/48)Ti^*\}\geqq 0.0005 \quad (1)$$

$$0\leqq C-\{(12/93)Nb+(12/48)Ti^*\}\leqq 0.0015 \quad (2)$$

wherein Ti*=Ti−{(48/32)S+(48/14)N} said cold-rolled steel sheet having a bake hardenability BH of 10 to 30 MPa obtained by 2% tensile prestrain and 170° C.×20 min heat treatment;

said bake hardenability BH (MPa) and a yield strength YP (MPa) of said steel sheet satisfying the following formulae (3*b*) and (4*b*)

$$BH\geqq \exp(-0.115\cdot YP+25.3) \quad (3b)$$

$$0.67 \cdot BH + 177 \leqq YP \leqq -0.8 \cdot BH + 260 \quad (4b).$$

5. The cold-rolled steel sheet of claim 1, wherein said steel composition contains 0.0002 to 0.0015 wt % of B.

6. A cold-rolled steel sheet of claim 1, wherein said cold-rolled steel sheet is coated with a zinc or zinc alloy layer.

7. The cold-rolled steel sheet of claim 1, wherein the steel sheet has a composition selected from the group consisting of (a) 0.0019 wt. % C, 0.02 wt. % Si, 0.56 wt % Mn, 0.35 wt % P, 0.011 wt % S, 0.044 wt % sol.Al, 0.0021 wt % N, 0.006 wt % Nb, with the remainder being Fe;

(b) 0.0023 wt % C, 0.01 wt % Si, 0.48 wt % Mn, 0.028 wt % P, 0.009 wt % S, 0.0045 wt % sol.Al, 0.0018 wt % N, 0.011 wt % Nb, with the remainder being Fe;

(c) 0.0018 wt % C, 0.02 wt % Si, 0.92 wt % Mn, 0.032 wt % P, 0.007 wt % S, 0.054 wt % sol.Al, 0.0016 wt % N, 0.009 wt % Nb, with the remainder being Fe;

(d) 0.0022 wt % C, 0.01 wt % Si, 0.25 wt % Mn, 0.029 wt % P, 0.012 wt % S, 0.043 wt % sol.Al, 0.0025 wt % N, 0.009 wt % Nb, with the remainder being Fe;

(e) 0.0019 wt % C, 0.01 wt % Si, 1.25 wt % Mn, 0.014 wt % P, 0.009 wt % S, 0.041 wt % sol.A1, 0.0024 wt % N, 0.015 wt % Nb, with the remainder being Fe;

(f) 0.005 wt % C, 0.02 wt % Si, 0.35 wt % Mn, 0.042 wt % P, 0.01 wt % S, 0.051 wt % sol.Al, 0.0022 wt % N, 0.029 wt % Nb, with the remainder being Fe;

(g) 0.007 wt % C, 0.01 wt % Si, 0.66 wt % Mn, 0.025 wt % P, 0.011 wt % S, 0.041 wt % sol.A1, 0.0019 wt % N, 0.046 wt % Nb, with the remainder being Fe;

(h) 0.0021 wt % C, 0.01 wt % Si, 0.52 wt % Mn, 0.039 wt % P, 0.009 wt % S, 0.048 wt % sol.Al, 0.0018 wt % N, 0.023 wt % Ti, with the remainder being Fe;

(i) 0.0021 wt % C, 0.02 wt % Si, 0.53 wt % Mn, 0.039 wt % P, 0.018 wt % S, 0.052 wt % sol.Al, 0.0039 wt % N, 0.045 wt % Ti, with the remainder being Fe;

(j) 0.0022 wt % C, 0.01 wt % Si, 0.53 wt % Mn, 0.039 wt % P, 0.018 wt % S, 0.052 wt % sol.Al, 0.0039 wt % N, 0.045 wt % Ti, with the balance being Fe;

(k) 0.0023 wt % C, 0.01 wt % Si, 0.48 wt % Mn, 0.025 wt % P, 0.012 wt % S, 0.044 wt % sol.Al, 0.0022 wt % N, 0.055 wt % Ti, with the balance being Fe;

(l) 0.0019 wt % C, 0.01 wt % Si, 0.53 wt % Mn, 0.024 wt % P, 0.009 wt % S, 0.066 wt % sol.Al, 0.0017 wt % N, 0.014 wt % Nb, 0.024 wt % Ti, with the remainder being Fe; and (m) 0.0085 wt % C, 0.01 wt % Si, 0.37 wt % Mn, 0.03 wt % P, 0.01 wt % S, 0.051 wt % sol.Al, 0.0018 wt % N, 0.04 wt % Nb, 0.03 wt % Ti, with the remainder being Fe.

8. The cold-rolled steel sheet of claim 1, wherein the steel composition includes 0.005 to 0.08 wt % Nb.

9. The cold-rolled steel sheet of claim 1, wherein the steel composition includes 0.01 to 0.07 wt % Ti.

10. The cold-rolled steel sheet of claim 1, wherein the steel composition includes 0.005 to 0.08 wt % Nb and 0.01 to 0.07 wt % Ti.

11. The cold-rolled steel sheet of claim 5, wherein the steel sheet has a composition selected from the group consisting of (a) 0.0021 wt % C, 0.02 wt % Si, 0.43 wt % Mn, 0.034 wt % P, 0.012 wt % S, 0.042 wt % sol.A1, 0.0021 wt % N, 0.001 wt % Nb, 0.0008 wt % B, with the remainder being Fe;

(b) 0.0024 wt % C, 0.01 wt % Si, 0.43 wt % Mn, 0.032 wt % P, 0.011 wt % S, 0.062 wt % sol.Al, 0.0026 wt % N, 0.033 wt % Ti, 0.0009 wt % B, with the remainder being Fe; and (c) 0.0021 wt % C, 0.02 wt % Si, 0.38 wt % Mn, 0.023 wt % P, 0.008 wt % S, 0.052 wt % sol.A1, 0.0019 wt % N, 0.009 wt % Nb, 0.018 wt % Ti, 0.0005 wt % B, with the remainder being Fe.

* * * * *